US006748363B1

(12) United States Patent
Lueck et al.

(10) Patent No.: US 6,748,363 B1
(45) Date of Patent: Jun. 8, 2004

(54) TI WINDOW COMPRESSION/EXPANSION METHOD

(75) Inventors: Charles D. Lueck, Dallas, TX (US); Alec C. Robinson, Dallas, TX (US); Jonathan L. Rowlands, Somerville, MA (US); Jeffrey S. Hayes, Houston, TX (US)

(73) Assignee: Texas Instruments Incorporated, Dallas, TX (US)

( * ) Notice: Subject to any disclaimer, the term of this patent is extended or adjusted under 35 U.S.C. 154(b) by 504 days.

(21) Appl. No.: 09/605,930

(22) Filed: Jun. 28, 2000

(51) Int. Cl.[7] ..... G10L 19/00
(52) U.S. Cl. ..... 704/500; 704/200.1; 704/229
(58) Field of Search ..... 704/500, 229, 704/200.1, 503, 203, 205, 219

(56) References Cited

U.S. PATENT DOCUMENTS 5,109,417 A * 4/1992 Fielder et al. ..... 704/205
5,357,594 A * 10/1994 Fielder ..... 704/200.1
5,394,473 A * 2/1995 Davidson ..... 704/200.1
5,852,806 A * 12/1998 Johnston et al. ..... 704/500
5,903,872 A * 5/1999 Fielder ..... 704/500
5,956,674 A * 9/1999 Smyth et al. ..... 704/200.1
6,226,608 B1 * 5/2001 Fielder et al. ..... 704/229
6,304,847 B1 * 10/2001 Jhung ..... 704/500
6,487,535 B1 * 11/2002 Smyth et al. ..... 704/500

* cited by examiner

*Primary Examiner*—Richemond Dorvil
*Assistant Examiner*—Kinari Patel
(74) *Attorney, Agent, or Firm*—Wade James Brady, III; Frederick J. Telecky, Jr.

(57) ABSTRACT

According to the present invention, there is developed a proprietary technology for compressing the window tables of audio coders to ⅛ their original size (or less) without any loss of quality. This technology can be applied to all transform based audio coders, or any audio coder that uses a windowing stage. The novel technique for reducing storage requirements for the window tables of audio coders is based on multiple differentiation. Since the difference between any two adjacent samples in the first difference signal is small, so it is more efficient to store this difference. This technique can be carried out several more times, until the returns get smaller, and the computational requirements to "undo" the compression go up. The optimum number of times to differentiate is dependent on the particular application and the window shape.

15 Claims, 1 Drawing Sheet

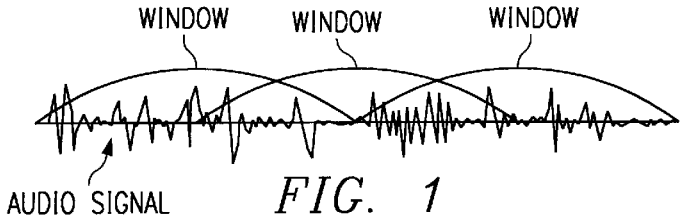
FIG. 1
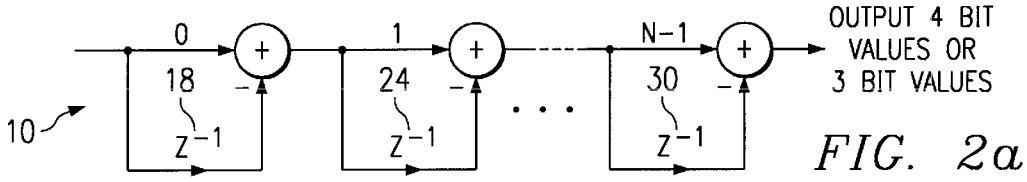
FIG. 2a
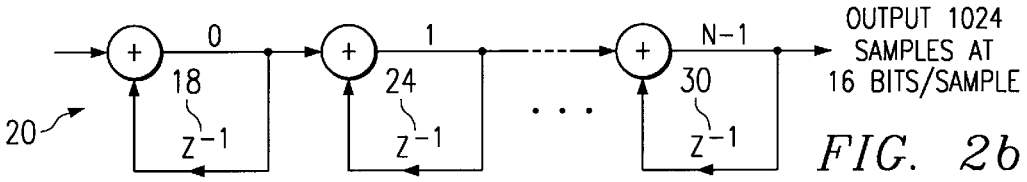
FIG. 2b
| WINDOW SAMPLE MEASUREMENT VALUES | 0 | 1 | 2 | 3 | 5 | 7 | 10 | 15 | 20 |
|---|---|---|---|---|---|---|---|---|---|
| 1st FILTER STAGE | 1 | 1 | 1 | 2 | 2 | 3 | 5 | 5 | |
| 2nd FILTER STAGE | 0 | 0 | 1 | 0 | 1 | 2 | 0 | | |
| 3rd FILTER STAGE | 0 | 1 | −1 | 1 | 1 | 0 | | | |
| 4th FILTER STAGE | 1 | 2 | −2 | 0 | 1 | | | | |
FIG. 3
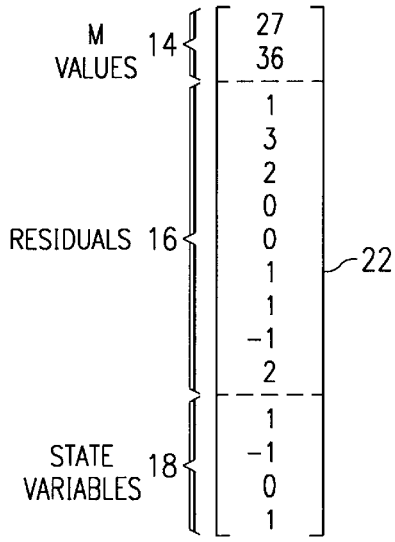
FIG. 5
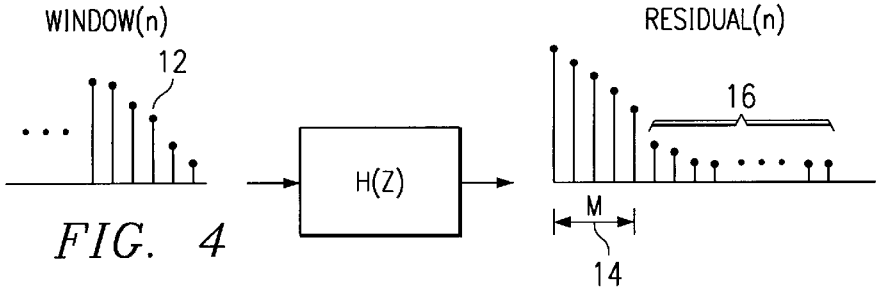
FIG. 4

TI WINDOW COMPRESSION/EXPANSION METHOD

TECHNICAL FIELD OF INVENTION

The present invention relates to a technology for compression/expansion methods that can be applied to all transform based audio coders, or any audio coder using a windowing stage.

BACKGROUND OF THE INVENTION

In 1991, the Motion Pictures Experts Group (MPEG), a group developed under the International Standards Organization(ISO), created an audio video system standard MPEG-1. MPEG-1 had three 'layers', the first two layers 1 and 2 were more simple audio coding and decoding algorithms, whereas the third layer, named MP3, was a much more complex audio coding and decoding system which just recently, has received alot of notoriety. MPEG-1 is a mono channel, stereo standard which operates at a 32–48 khz sampling rate. Around 1994, MPEG-2 was created which comprised of the same three layers, but this time was multichannel, or otherwise named (5.1) for 5 directions and one sub-woofer: Center, Left, Right, Left Surroundsound, Right Surroundsound and Low Frequency Exciter(LFE). MPEG-2 also operated at a much lower sampling rate, 12–32 kHz versus the 32–48 kHz of MPEG-1. In addition, MPEG-2 was backward compatible (BAC) with MPEG-1, which meant that MPEG-2 could play all MPEG-1 data streams.

More recently, around 1997, the thinking was that the audio coding and decoding standard could be made much more optimum if the standard did not have to be backward compatible (BAC). As a result, the audio coding and decoding standard, MPEG-2 non-backward compatible (NBC) was developed and it, as the name implies, was not backward compatible with the previous standards, MPEG-1 and MPEG-2. This standard was not commercially desirable (because of the 'non-backward compatible' in the name) and so was changed to MPEG-2 Advanced Audio Coding (MC). MPEG-2 AAC is a multichannel system of up to 48 channels (foreign language applications are now enabled) and has a mono equivalence, if comparing against a mono standard like MP3(the third layer of MPEG-1) of 64 kbps versus MP3@64 kbps.

In any transform based audio decoder, there is a final "window-overlap-add" stage that converts the decompressed data into time domain output samples. The main data requirements to implement this stage are an input buffer containing the current decompressed data, a state buffer containing the previous decompressed data, and a constant table storing the "window" coefficients. These window-tables directly effect the quality of the output signal, and in order to keep this quality high, the tables require a significant amount of storage, about 2–4 k. In addition many of the audio compression algorithms provide support for multiple window shapes, so the storage requirements can increase to 4–8 k or more. In embedded applications, where memory is very limited, reducing the size of these tables is a necessity.

SUMMARY OF THE INVENTION

According to the present invention, there is developed a proprietary technology for compressing the window tables of audio coders to ⅛ their original size (or less) without any loss of quality. This technology can be applied to all transform based audio coders, or any audio coder that uses a windowing stage. The novel technique for reducing storage requirements for the window tables of audio coders is based on multiple differentiation. Since the difference between any two adjacent window samples is relatively small, it is more efficient to store this difference. This technique can be carried out several more times, until the returns get smaller, and the computational requirements to "undo" the compression go up. The optimum number of times to differentiate is dependent on the particular application and the window shape.

BRIEF DESCRIPTION OF DRAWINGS

FIG. 1 illustrates the process of window-overlap-add, illustrating that each window overlaps the previous one by one half.

FIG. 2*a* illustrates signal processing flow diagrams of the window compression procedure on the window compression filter 10 according to a preferred embodiment of the invention.

FIG. 2*b* illustrates signal processing flow diagrams of the window expansion procedure on the window expansion filter 20 according to a preferred embodiment of the invention.

FIG. 3 illustrates an example of an implementation of the window compression filter procedure on the window compression filter 10.

FIG. 4 illustrates a flow diagram of the window compression technique according to a preferred embodiment of the invention.

FIG. 5 illustrates an example of a compressed window table 22 according to is preferred embodiment of the invention.

DETAILED DESCRIPTION OF THE PREFERRED EMBODIMENTS

The concept of window-overlap-add is most easily described from the audio encoder point of view. When implementing most any audio compression algorithm, the time domain input signal (audio off a compact disc for example) is split up into overlapping sections of samples, which are each multiplied by a window and analyzed with the aide of a transform. FIG. 1 visually demonstrates how the windows of each section overlap in this procedure. In other words, FIG. 1 illustrates the process of window-overlap-add. Notice that each window overlaps the previous one by one half.

The overlapping sections provide a means for increasing time resolution, and reducing discontinuity effects resulting from quantizing the transform output values (this is how data reduction is achieved). An audio decoder needs to reverse the steps preformed in the encoder, so here too, a window-overlap-add stage is required. The shape of the window is chosen such that when it is squared and overlap-added with itself, it adds up to a constant. With the AAC sine window, we can easily verify that it meets this constraint.

The ACC sin window is defined as, $$W_{aac\text{-}\sin}(n) = \sin\left(\frac{\pi}{2048}\cdot\left(n+\frac{1}{2}\right)\right) \text{ for } 0 \le n \le 2048$$

From the two (analysis and synthesis) window-overlap-add stages, we get the following equation:

$$W^2_{aac\text{-}\sin}(n) + W^2_{aac\text{-}\sin}\left(n + 1024 = \sin^2\left(\frac{\pi}{2048}\cdot\left(n+\frac{1}{2}\right)\right) + \sin^2\left(\frac{\pi}{2048}\cdot\left(n+\frac{1}{2}+1024\right)\right)\right.$$

$$= \sin^2\left(\frac{\pi}{2048}\cdot\left(n+\frac{1}{2}\right)\right) + \sin^2\left(\frac{\pi}{2048}\cdot\left(n+\frac{1}{2}\right)+\frac{1}{2}\right)$$

$$= \sin^2\left(\frac{\pi}{2048}\cdot\left(n+\frac{1}{2}\right)\right) + \cos^2\left(\frac{\pi}{2048}\cdot\left(n+\frac{1}{2}\right)\right)$$

$$= 1$$

To show how much data is required by these window tables 22, this section will do the memory calculations using MPEG-2 ACC as an example. There are two different window shapes of which the encoder must be apprised and those are the sine shape and the dolby shape. The sine shape is the sine wave function and is therefore predictable throughout the entirety of the window. Storing only a quarter of the sine window shape will allow a reproduction of the window shape in it's entirely. The dolby window shape is a different story. The dolby window shape does not follow a known function, like sine, but rather has some shape(defined by a proprietary algorithm owned by Dolby), very similar to a sine wave, that is symmetric about the center point of the window. Because the dolby shape is symmetric about the center point of the window, we must store at least half of the dolby shape window to reproduce the entire window. Because we are storing half the window for the dolby shaped window, we will also store half the window of the sine window shape.

The window length in ACC is 2048 samples for long transforms and 256 samples for short transforms. In other words, sample long transforms 2048 times per window and sample short transforms 256 times per window. As previously stated, the designers of the algorithm made the window shapes symmetric so only 1024 window samples need to be stored. For the decoder to be capable of producing high quality output, these window sample tables 22 need to be stored with at least 16-bit precision(2 bytes) and preferably 32-bit precision(4 bytes). For the highest quality, this means one long window in ACC takes 4 Bytes×1024samples=4096 Bytes of storage. For the short windows storage is 4 Bytes× 128 samples=512 Bytes. To make storage requirements even worse, ACC supports 2 different shapes of windows so the total is 2×(4096+512)=9216 Bytes. Clearly, reducing this number is desirable in an embedded application when memory or cache restraints are tightest.

The method of using multiple differentiation to compress the window tables of audio coders according to a preferred embodiment can be described with a signal-processing diagram as illustrated in FIG. 2*a*. Consider the window coefficients 18 to be the input signal to a two-tap FIR filter with coefficients {1,−1}. The difference equation for this filter is:

$$y(n)=x(n)-x(n-1),$$

the z-transform for which is:

$$H(z)=1-z^{-1}$$

Calculating multiple differences is equivalent to running this filter in series. If N successive differences are calculated, the z-transform for the system is:

$$H_N(Z)=(1-Z^{-1})^N$$

Before the compressed table 22 can be used, it must be decompressed in the decoder by filtering it with:

$$H_N^{-1}(z) = \frac{1}{(1-z^{-1})^N} = \left(\frac{1}{(1-z^{-1})}\right)^N$$

This is equivalent running the filter $$H(z) = \frac{1}{(1-z^{-1})},$$

N times in series. The difference equation for this filter is $$y(n)=x(n)+y(n-1).$$

FIG. 2*a* illustrates signal processing flow diagrams of the window compression procedure implemented on the window compression filter 10 and FIG. 2*b* illustrates signal processing flow diagrams of the window expansion procedure implemented on the window expansion filter 20, both according to a preferred embodiment of the invention. The window compression performs a differentiation(or difference) on the window sample values and the window expansion performs an integration(or summation) on the window sample values. The input of the window compression filter 10 should equal the output of the window expansion filter 20, or in other words, the window sample values are differentiated in the window compression filter 10 and then the differentiated values are input to the window expansion filter 20, integrated, and then output as 16 bit window sample values. The number of first order filters to use is specified by N. N filters calculate the difference between the window sample measurements N times.

The calculation of the differences between the window sample measurement values with a four stage window compression filter 10, as an example of the window compression filter 10 illustrated in FIG. 2*a*, is illustrated in FIG. 3. A four stage filter is typically used for long transforms having 2048 samples a cycle and can generally be compressed into a 4 bit representation. A three stage filter is typically used for short transforms having 256 samples a cycle and can generally be compressed into an 8 bit representation. As is illustrated in FIG. 3, the initial window sample measurement values can vary greatly over a range of 0–20 and are represented as 32 bit values. After running the window through the window compression filter 10 of FIG. 2*a*, the output dynamic range of the compressed window 16 will be very small, and can thus be represented with fewer bits than it takes to represent the uncompressed window 12, as illustrated by the flow diagram of the window compression technique of FIG. 4. The number of bits to code the difference signal or "residual" 16 is determined from the largest absolute value in the difference signal, i.e. 4 bits for long transforms and 8 bits for short transforms. Unfortunately, the first few values, M 14, in the difference are usually large relative to the rest of the values, and the compression ratio suffers. In order to work around this problem, the first M values of the window 14 are stored in the compressed table 22, as illustrated in FIG. 5, in their uncompressed form, and the rest of the window sample values are differentially encoded and then stored in the same compressed table 22. In addition, the initial window coefficients of the filter 18, the coefficients of the $Z^{-1}$ variable of FIG. 2*a* 18, also called the initial state variables 18, are also stored, prior to execution of the window compression filter 10, as 32 bit values or, as described in more detail below, as 16 bit values in the compressed table 22(illustrated in FIG.

5). For this four stage example, assume that the first stage state variable 18 is stored as a 32 bit value, the second stage state variable 24 is stored as a 32 bit value, the third stage state variable is stored as a 16 bit value and the fourth stage state variable 30 is stored as a 16 bit value.

Again referring to FIG. 3, after the first stage of the window compression filter 10 illustrated in FIG. 2*a* or the first differentiation, the window sample values or residuals 16, now only cover the range of 1–5,. After the second, third, and fourth stages of the filter, where the window sample differences were calculated twice, then three then four times, respectively, the samples are then stored in the compressed table 22 as a 4 bit value, as illustrated in FIG. 5. This is a great reduction from the 32 bit values that are typically stored in the prior art window tables. In addition, throughout the filter stages, as described in more detail below, the arithmetic used for performing the subtractions can vary in precision from 32 bit to 16 bit or 8 bit as necessary.

Although provided above as an illustrative example of 4 stages, the number of window compression filter stages of the window compression filter 10 is dependent upon window shape and the particular application requirements. In addition, as previously stated, the initial state variables 18 of the window compression filter 10, or the window coefficients of the $Z^{-1}$ variable of FIG. 2*a* 18, which are the same initial state variables of the expansion filter 18, must be stored in the compressed table 22 prior to performance of the window compression filter 10. In an actual implementation of the window compression filter 10 and the window expansion filter 20, the state. buffer precision, or the number of bits representing each state variable value 18, and the number of bits used in performing the arithmetic(the arithmetic of subtracting or adding of the window sample values) in each stage of the window compression filter 10, and each stage of the window expansion filter 20, can be different. The first L<N stages of the window compression filter 10 can start out performing 32 bit arithmetic and store 32 bit state variable values. Somewhere in between the first and last filter stages, or for the last N-L window compression filter stages, the window compression filter 10 can begin performing only 16 bit arithmetic and storing 16 bit state variable values. If desired, the state variables can be stored and the arithmetic performed at even 8 bit or 4 bit levels, depending upon the application and the number of decoder output bits necessary. Similar to the window compression filter 10, but in a reversed order, the first L<N stages of the window expansion filter 20 can store just a 16-bit state variable value and perform 16 bit arithmetic. This means that only the last N-L expansion filter stages must maintain the 32-bit state. This optimization helps mainly in lowering the MIPS requirements for the filter.

FIG. 2*b* illustrates signal processing flow diagrams of the window expansion procedure implemented on the window expansion filter 20 according to a preferred embodiment of the invention. The process of reconstructing the initial window values from: 1) the stored 4 bit compressed window values 16, 2) the initial state variables 18 (stored as 32 or 16 or 8 bit values), 3) and the M initial sample values 14 is now described in detail. Initially, a memory buffer is accessed. This memory buffer is not a dedicated memory buffer, but any buffer that will allow storage of at least 1024 samples× 16 bits/sample for long transforms and at least 128 samples× 16 bits/sample for short transforms(or one window of information a buffer). The window expansion filter 20 will write over the current contents of the buffer, so the buffer need not be cleared prior to the window expansion filter 20 executing and then writing the results. Once appropriated, the first M 14 window sample values that were stored uncompressed as 32 bit values in the compression table 22 are copied into the first section of the buffer. Next, the initial state variables 18 of the window expansion filter 20, or those window coefficients of the $Z^{-1}$ variable 18 , are set according to the initial state variables 18 that existed in the window compression filter 10 prior to execution of the window sample compression. By setting the initial state variables 18 of the window expansion filter 20 to the same values as the initial state variables 18 of the window compression filter 10, the adverse effect that a window sample is lost every time the difference is taken between two samples is removed. The final step is running the window expansion filter 20 using a fourth order difference(having four stages) for long transforms and a third order difference(having three stages) for short transforms. The output of the window expansion filter 20 should be identical to the input of the window compression filter 10, and therefore should be 1024 samples of 16 bits/sample for long transforms and 128 samples of 16 bit/sample for short transforms. As previously stated, the buffer holds one window of data. Therefore, for each window that is compressed, the buffer must write anew a new expanded window.

Although FIG. 5 illustrates a particular example of the window compression table 22 with the different elements, of M initial values 14, initial state variables 18, and the residuals 16, although these are the elements that need to be stored in the compressed window sample table, the order in which they are stored is not a distinction that must be made. In addition, the number of M values 14, or residuals 16, or state variables 18 that are shown to be stored in compressed window table 22 is simply an example of each element, while the actual number stored will be dependent upon the factors listed previously in the specification.

We claim:

1. A method of compressing the window tables of any transform based audio encoder comprising the steps of:

sampling a window of data a predetermined number of times and yielding a first few of window sample values and the rest of window sample values;

providing a window compression filter, having more than one stage and each stage having an initial state variable prior to execution of said filter;

providing a compressed window table in memory for storing at least said first few of window sample values and said initial state variables of said window compression filter; and differentially encoding said rest of window sample values in said window compression filter and storing said compressed window samples in said compressed window table.

2. The method according to claim 1, wherein said first few window sample values are the largest values of the window sample values of said window of date.

3. The method of claim 1, wherein said window compression filter has 4 stages.

4. The method according to claim 1, wherein said differentially encoding of said rest of window sample values performs a subtraction between adjacent window sample values per stage of said window compression filter.

5. The method according to claim 4, wherein said subtraction occurs with different precision per stage of said window compression filter.

6. The method according to claim 1, wherein said initial state variables are stored with different precision per stage of said window compression filter.

7. The method according to claim 2, wherein said largest of said window sample values are stored in said compressed table as uncompressed data.

8. A method of compressing and expanding the window tables of any transform based audio decoder comprising the steps of:

sampling a window of data a predetermined number of times and yielding a first few of window sample values and the rest of window sample values;

providing a window compression filter, having more than one stage and each stage having an initial state variable of an initial value prior to execution of said filter;

providing a compressed window table in memory for storing at least said first few of window sample values and said initial state variables of said window compression filter;

differentially encoding said rest of window sample values in said window compression filter and storing said compressed window samples in said compressed window table;

providing an available buffer in memory;

providing a window expansion filter, having more than one stage and each stage having an initial state variable;

storing said first few window samples in said buffer;

setting said window expansion filter initial state variables to the initial values of the initial state variable of said window compression filter;

expanding said compressed window samples in said window expansion filter, yielding expanded window samples and storing said expanded window samples in said buffer along with said first few window samples; and outputting said buffer contents once a window.

9. The method according to claim 8, wherein said first few window sample values are the largest values of the window sample values of said window of data.

10. The method according to claim 8, wherein said window compression filter has 4 stages.

11. The method according to claim 8, wherein said differentially encoding of said rest of window sample values performs a subtraction between adjacent window sample values per stage of said window compression filter.

12. The method according to claim 11, wherein said subtraction occurs with different precision per stage of said window compression filter.

13. The method according to claim 8, wherein said initial state variables are stored with different precision per stage of said window compression filter.

14. The method of claim 9, wherein said largest of said window sample values are stored in said compressed table as uncompressed data.

15. The structure of a window table compressor of a transform based audio encoder comprising:

a predetermined number of window sample values of a window of data yielding a first few of window sample values and the rest of window sample values;

a window compression filter, having more than one stage and each stage having an initial state variable, prior to execution of said filter;

a compressed window table in memory for storing at least said first few of window sample values and said initial state variables of said window compression filter; and;

wherein said window compression filter differentially encodes said rest of window sample values and storing said differentially encoded window samples in said compressed window table.

* * * * *